US007467924B2

(12) United States Patent
Charbonneau et al.

(10) Patent No.: US 7,467,924 B2
(45) Date of Patent: Dec. 23, 2008

(54) TURBINE BLADE INCLUDING REVISED PLATFORM

(75) Inventors: Robert A. Charbonneau, Meriden, CT (US); Kenneth P. Botticello, West Suffield, CT (US); Shawn J. Gregg, Wethersfield, CT (US); Kirk David Hlavaty, East Hartford, CT (US); Jeffrey R. Levine, Wallingford, CT (US); Kenneth A. Lonczak, Meriden, CT (US); Craig R. McGarrah, Southington, CT (US); Dominic J. Mongillo, West Hartford, CT (US); Lisa P. O'Neill, Manchester, CT (US); Edward Pietraszkiewicz, Southington, CT (US); Richard M. Salzillo, Plantsville, CT (US); Heather Ann Terry, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 576 days.

(21) Appl. No.: 11/205,274

(22) Filed: Aug. 16, 2005

(65) Prior Publication Data

US 2007/0041838 A1 Feb. 22, 2007

(51) Int. Cl.
*F01D 5/10* (2006.01)

(52) U.S. Cl. ..... 416/193 A; 416/248

(58) Field of Classification Search ..... 416/193 A, 416/248

See application file for complete search history.

(56) References Cited

U.S. PATENT DOCUMENTS 4,182,598 A * 1/1980 Nelson ..... 416/193 A
4,455,122 A * 6/1984 Schwarzmann et al. . 416/193 A
4,505,642 A * 3/1985 Hill ..... 416/193 A
5,228,835 A * 7/1993 Chlus ..... 416/193 A
5,284,421 A * 2/1994 Chlus et al. ..... 416/248
5,313,786 A * 5/1994 Chlus et al. ..... 416/193 A
5,415,526 A * 5/1995 Mercadante et al. .... 416/193 A
5,785,499 A * 7/1998 Houston et al. ..... 416/248
5,827,047 A * 10/1998 Gonsor et al. ..... 416/193 A
5,924,699 A * 7/1999 Airey et al. ..... 416/193 A
6,171,058 B1 * 1/2001 Stec ..... 416/193 A
6,270,318 B1 * 8/2001 Shah et al. ..... 416/193 A
6,435,830 B1 * 8/2002 Allen et al. ..... 416/193 A

* cited by examiner

*Primary Examiner*—Richard Edgar
(74) *Attorney, Agent, or Firm*—Carlson, Gaskey & Olds

(57) ABSTRACT

The present invention provides a turbine blade having a revised under-platform structure including a unique coating combination that reduces mechanical stress factors within the turbine blade. The turbine blade includes a platform with an airfoil extending upwardly from the airfoil and a root portion extending downwardly from the platform. Two suction side tabs extend a first distance outward from a suction side of the root potion. Two pressure side tabs extend outward from a pressure side of the root portion. One of the two pressure side tabs extends outward a distance similar to the first distance, however, the other of the two pressure side tabs extends outward a distance much smaller than the first distance, which reduces stresses acting on the turbine blade. In addition, a plurality of coatings are systematically applied to the turbine blade to further reduce mechanical stress factors and improve cooling.

16 Claims, 4 Drawing Sheets

TURBINE BLADE INCLUDING REVISED PLATFORM

BACKGROUND OF THE INVENTION

This application relates generally to a turbine blade for a gas turbine engine wherein a tab structure under the platform is modified.

Conventional gas turbine engines include a compressor, a combustor and a turbine assembly that has a plurality of adjacent turbine blades disposed about a circumference of a turbine rotor. Each turbine blade typically includes a root that attaches to the turbine rotor, a platform, and a blade that extends radially outwardly from the turbine rotor.

The compressor receives intake air. The intake air is compressed by the compressor and delivered primarily to the combustor where the compressed air and fuel are mixed and burned in a constant pressure process. A portion of the compressed air is bled from the compressor and fed to the turbine to cool the turbine blades.

The turbine blades are used to provide power in turbo machines by exerting a torque on a shaft that is rotating at a high speed. As such, the turbine blades are subjected to a myriad of mechanical stress factors. In addition, the turbine blades are typically cooled using relatively cool air bled from the compressor resulting in temperature gradients being formed, which can lead to additional elements of thermal-mechanical stress within the turbine blades.

Further, because the turbine blades are located downstream of the combustor where fuel and air are mixed and burned in a constant pressure process, they are required to operate in an extremely harsh environment. Traditionally, a chromium-based coating is applied to the entire turbine blade to resist the corrosive effects associated with this harsh environment. The traditional coating protects primarily against stress corrosion in areas of low stress concentration, however, the traditional coating does not provide adequate protection against stress corrosion in areas of high stress concentration, for example, under the platform.

As such, it is desirable to provide a turbine blade that is optimized to reduce the effects of the mechanical and environmental stress factors.

SUMMARY OF THE INVENTION

The present invention provides a turbine blade having a revised under-platform structure, including a novel coating process and a configuration that reduces mechanical and environmental stress factors within the turbine blade.

The turbine blade includes a platform with an airfoil extending upwardly from the platform and a root portion extending downwardly from the platform. The turbine blade has a pressure side and a suction side. Two suction side tabs extend a first distance outwardly from the suction side of the root portion below the platform. Two pressure side tabs extend outwardly from the pressure side of the root portion below the platform. One of the two pressure side tabs extends outwardly a distance similar to the first distance, however, the other of the two pressure side tabs extends outwardly a second distance that is significantly less than the first distance. The shorter of the two pressure tabs regionally decreases mechanical stress factors within the turbine blade.

In addition, a plurality of coatings are systematically placed and layered to reduce mechanical and environmental stress factors. A first coating is applied to substantially cover the turbine blade on both sides of the platform. The first coating protects against corrosion in areas of low stress concentration. However, the area under the platform of the turbine blade at the root portion is subjected to much higher stress concentrations than other areas of the turbine blade. Therefore, a second coating is applied over the first coating only under the platform. The second coating is added to resist corrosion cracking in areas of high stress concentration. The second coating is applied using a line-of-sight coating process through an access area that is created as a result of the shortened pressure side tab. The second coating is applied underneath the platform by spraying the coating directly at the shorter of the two pressure side tabs. Additional coatings are applied to the turbine blade to further reduce the effects of stress.

These and other features of the present invention can be best understood from the following specification and drawings, the following of which is a brief description.

DETAILED DESCRIPTION OF THE PREFERRED EMBODIMENT

Figure 1:
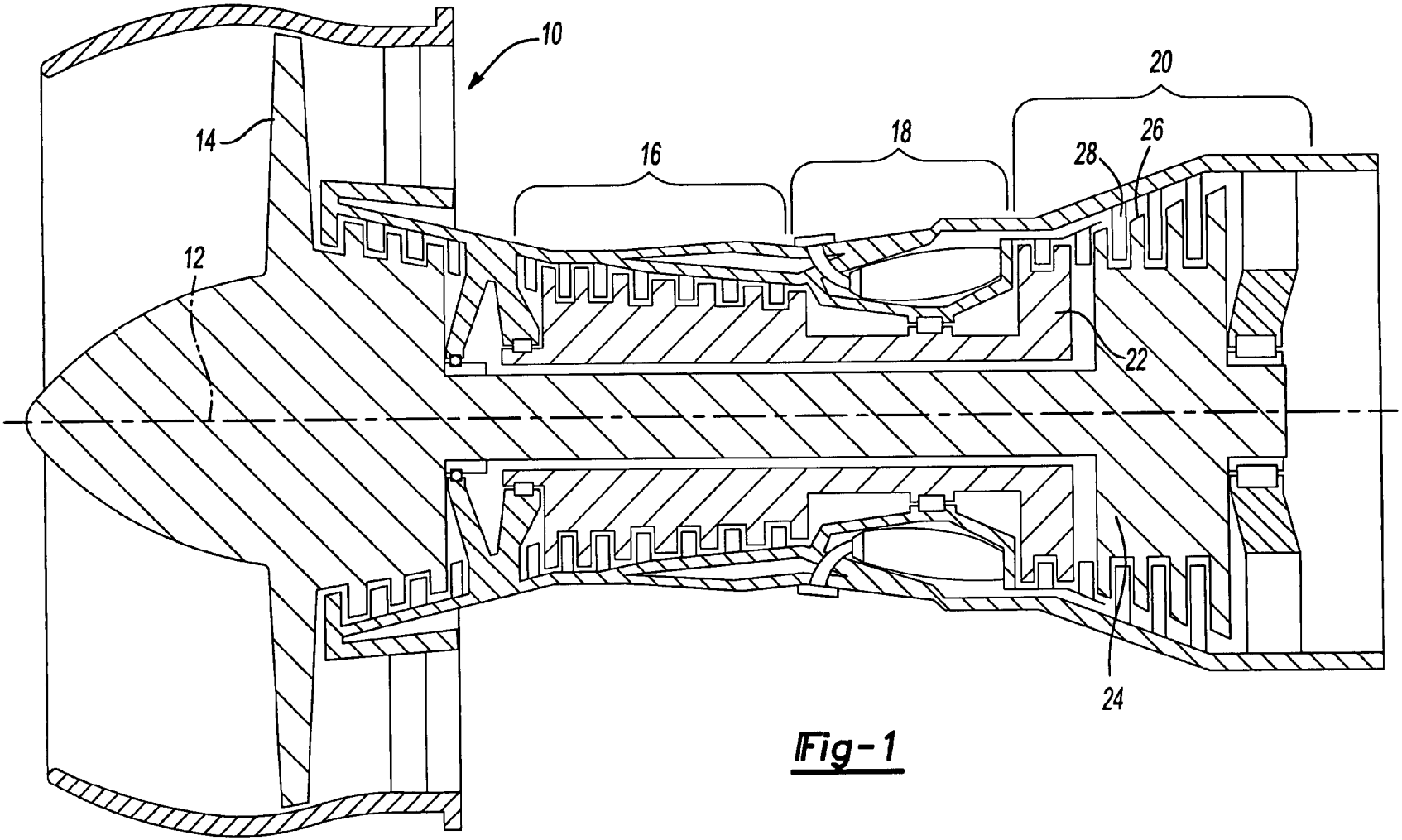
FIG. 1 is a schematic illustration of an example gas turbine engine.

FIG. 1 is a schematic illustration of an example gas turbine engine 10 circumferentially disposed about an engine centerline, or axial centerline axis 12. The example gas turbine engine 10 includes a fan 14, a compressor 16, a combustor 18, and a turbine assembly 20. As is known, intake air from the fan 14 is compressed in the compressor 16, the compressed air is mixed with fuel that is burned in the combustor 18 and expanded in the turbine assembly 20. The turbine assembly 20 includes rotors 22 and 24 that, in response to the expansion, rotate, driving the compressor 16 and the fan 14. The turbine assembly 20 includes alternating rows of rotary blades 26 and static airfoils or vanes 28, which are mounted to the rotors 22 and 24. The example gas turbine engine 10 may, for example, be a gas turbine used for power generation or propulsion. However, this is not a limitation on the present invention, which may be employed on gas turbines used for electrical power generation, in aircraft, etc.

Figure 2:
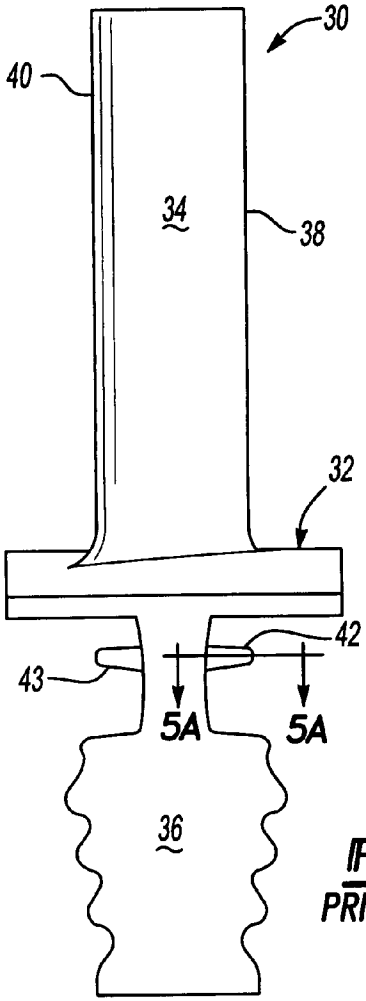
Fig-2 PRIOR ART
FIG. 2 illustrates a prior art turbine blade.

FIG. 2 schematically illustrates a prior art turbine blade 30 having a platform 32, with an airfoil 34 extending upwardly from the platform 32 and a root 36 extending downwardly from the platform 32. The turbine blade 30 includes a pressure side 38 and a suction side 40. A first set of tabs 42 is disposed on the root 36 on the pressure side 38 of the turbine blade 30 below the platform 32. A second set of tabs 43 is disposed on the root 36 on the suction side 40 of the turbine blade 30 below the platform 32. Notably in FIG. 2, only one of each set of tabs 42 and 42 are shown. However, it should be understood a second tab is disposed behind the one illustrated tab.

The second set of tabs 43 extends outwardly from the root 36 on the suction side 40 in a first direction that is substantially parallel to the platform 32. The first set of tabs 42 extends outwardly from the root 36 on the pressure side 38 in a second direction, substantially opposite the first direction. The second direction is also substantially parallel to the platform 32.

Figure 3:
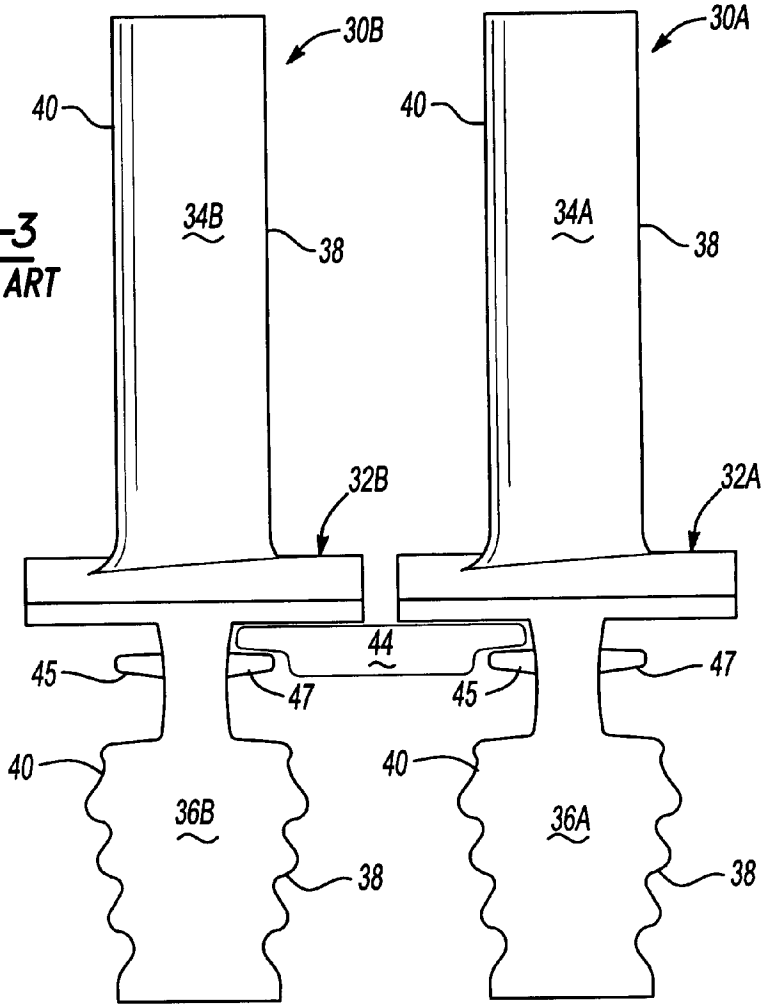
Fig-3 PRIOR ART
FIG. 3 illustrates a pair of prior art turbine blades.

FIG. 3 schematically illustrates a pair of adjacent prior art turbine blades 30A and 30B. Each turbine blade, 30A and 30B, includes a root 36, a platform 32 and an airfoil 34 as described previously in FIG. 2. A damper 44 is disposed between the adjacent turbine blades 30A and 30B, below the adjacent platforms 32A and 32B. The damper 44 is positioned between a first set of tabs 45 disposed on the suction side 40 of root 36A of the turbine blade 30A and a second set of tabs 47 disposed on the pressure side 38 of the root 36B of the turbine blade 30B. Notably, as in FIG. 2, only one of each set of tabs 45 and 47 are shown. However, it should be understood a second tab is disposed behind the one illustrated tab.

Figure 4:
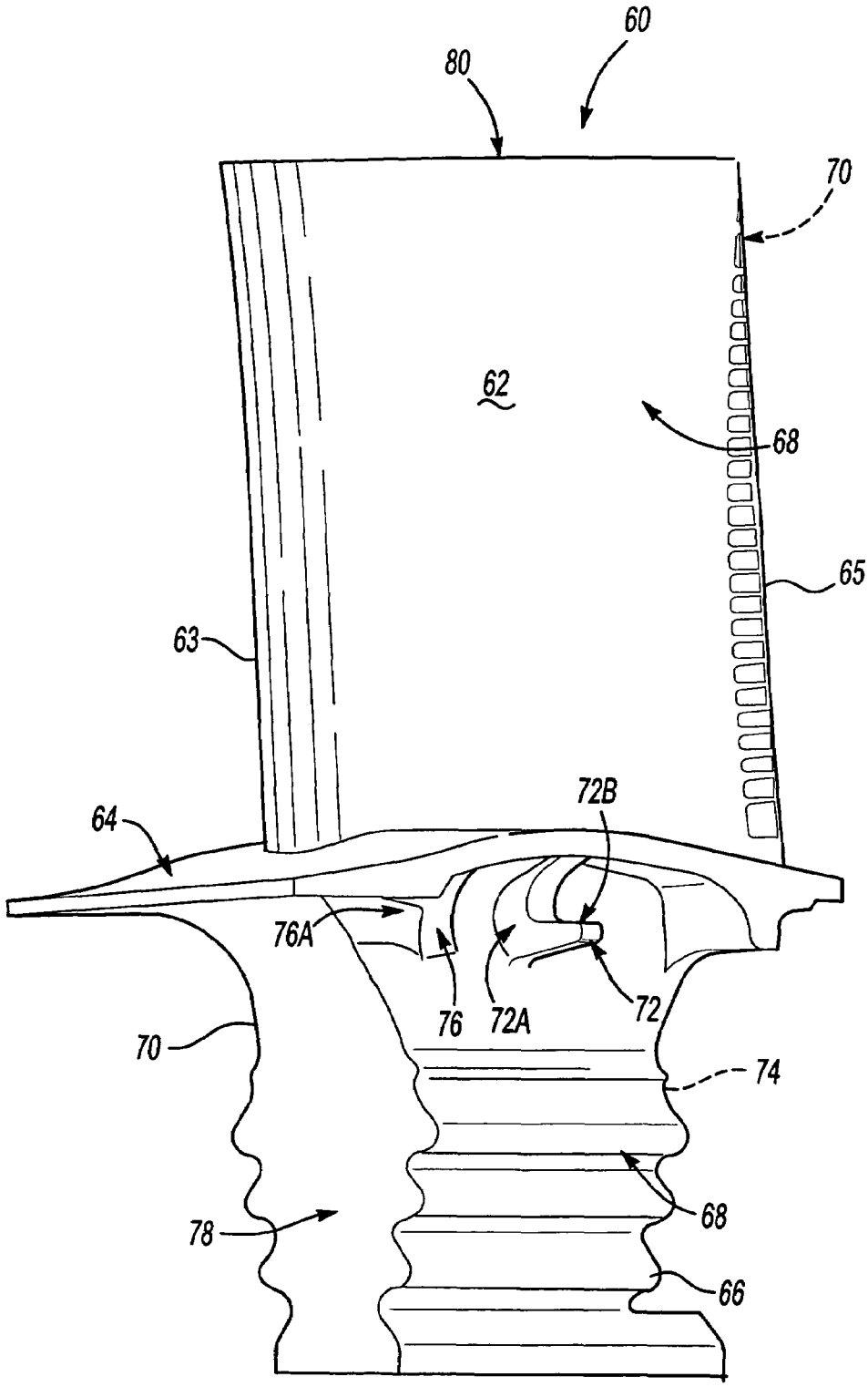
FIG. 4 illustrates an example turbine blade according to one embodiment of the present invention.

FIG. 4 illustrates a turbine blade 60 according to one embodiment of the present invention. The turbine blade 60 includes an airfoil 62 extending upwardly from one side of a platform 64 and a root 66 extending downwardly from the platform 64. The turbine blade 60 includes a leading edge 63 and a trailing edge 65 and has a pressure side 68 and a suction side 70. The root 66 includes a front face 78 adjacent to the leading edge 63 and a rear face 74 adjacent to the trailing edge 65. A first tab 72 is disposed on the pressure side 68 of the root 66 below the platform 64 and closest to the rear face 74 of the root 66. A second tab 76 is disposed on the pressure side 68 of the root 66 below the platform 64 and closest to the front face 78 of the root 66.

The first tab 72 and the second tab 76 extend outwardly from the pressure side 68 of the root 66 in a direction substantially parallel to the platform 64. The second tab 76 is significantly shorter than the first tab 72. A third tab and a fourth tab are positioned on the suction side 70 of the root 66, similar to the prior art, and have lengths that are similar to the first tab 72. The tabs are used to position the damper as shown in FIG. 3.

The first tab 72, the third tab and the fourth tab respectively include a base portion 72A and a post portion 72B. The second tab 76 includes only a base portion 76A. By only using the base portion 76A in this region, an amount of mechanical stress imposed on the turbine blade 60 in this region is reduced. While the inventive turbine blade 60 is disclosed for use in a first stage turbine assembly, the inventive turbine blade 60 may be used in any stage.

To further reduce the effects of stress on the turbine blade 60, a plurality of coatings are applied to specified portions of the turbine blade 60. A first coating, which in this example is a chromium-based coating, is applied to substantially cover the turbine blade 60 for corrosion protection. The first coating is applied to resist stress corrosion in areas of low stress concentration. Any type of chromium-based coating may be used.

Figure 5B:
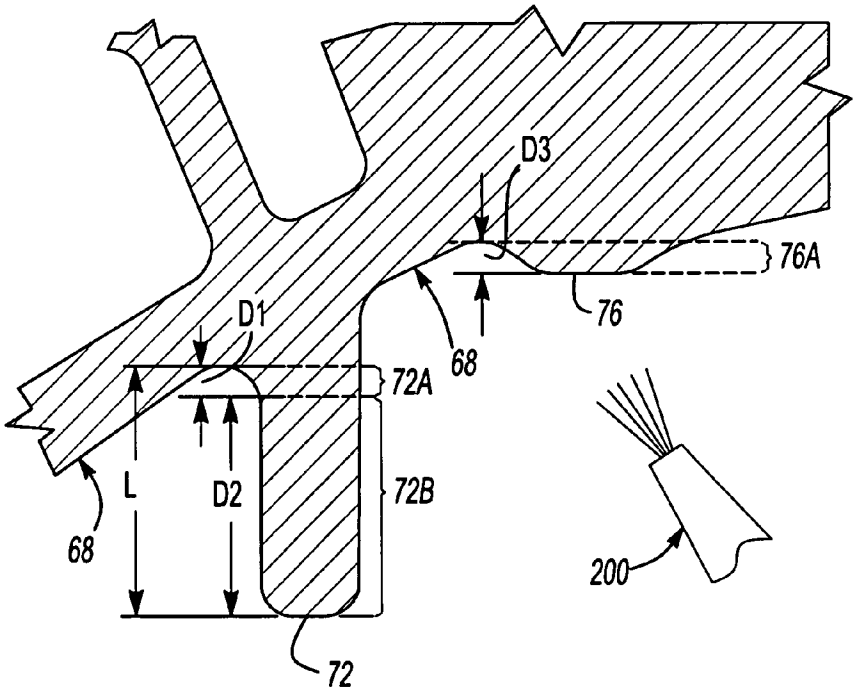
FIG. 5B shows a cross-section illustration of a pair of tabs according to one embodiment of the present invention.

A second coating is applied over the first coating to address high stress areas on the turbine blade 60. One high stress area is an area under the platform 64, more specifically a region surrounding the base portion 72A of the first tab 72 and including the first tab 72. This area is subjected to much higher stress concentrations than the remainder of the turbine blade 60. Further, the area under the platform 64 is susceptible to a different type of corrosion, that is, corrosion that occurs as a result of the high stress concentration. As such, the second coating, which is also chromium-based, is applied only under the platform 64 to resist stress corrosion is areas of high stress concentrations. This second coating is applied using a line-of-sight application process in which a sprayer, shown schematically at 200 in FIG. 5B, is positioned to deliver the second coating through an access area created as a result of the second tab 76 only having a base portion 76A. The second coating is sprayed underneath the platform by directing spray directly at the second tab 76. The application of the second coating may include heat treating prior to application to prepare the surface by removing oxidation to ensure proper adhesion of the second coating.

A third coating is applied over the first coating only on the airfoil 62. In this example, the third coating is a metallic-bond coating which assists in adherence of a fourth coating applied over the third coating only on the airfoil 62. This improves adhesion of a fourth coating, which in this example is a ceramic coating. The combination of coatings used on the airfoil 62 may include a heat treat process to ensure adhesion. Further, the combination of coatings reduces the effects of the harsh environment on the turbine blade 60.

Finally, a fifth coating is applied over the fourth coating only to a tip 80 of the turbine blade 60 to facilitate blade cutting. The fifth coating is a cubic boron nitride (CBN) coating. To ensure the tight clearances required by the turbine engine, the tips of the turbine blades are required to cut-in to the case surrounding the turbine engine. As such, the fifth coating is sacrificial, maintaining its integrity only long enough to ensure adequate run-in.

The types of coatings discussed above are examples of each coating and other types of coatings could also be used to provide the desired characteristics.

Figure 5A:
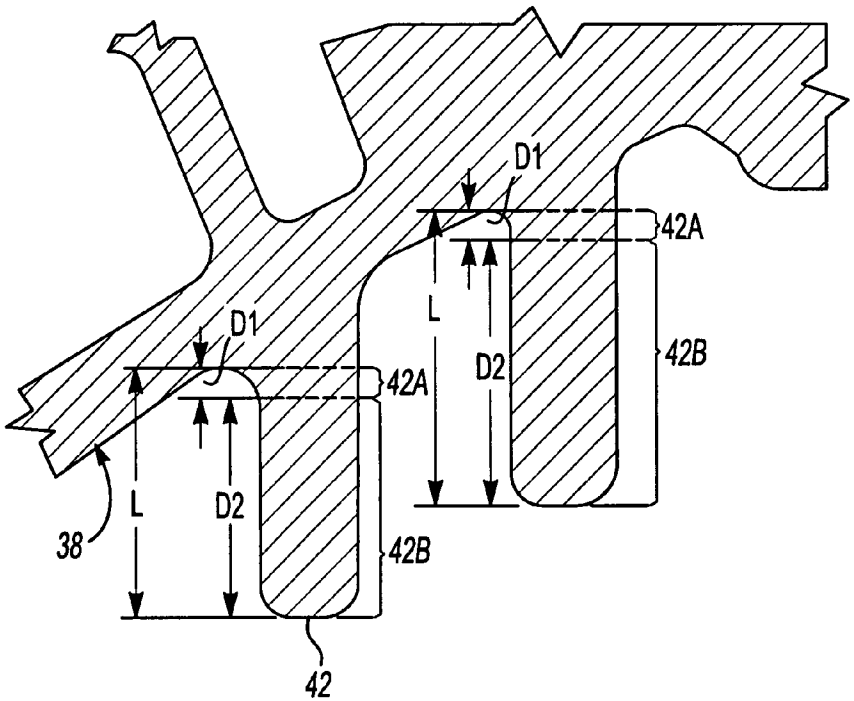
Fig-5A PRIOR ART
FIG. 5A shows a cross-sectional illustration of a pair of prior art tabs.

A comparison of the geometries of the tabs of the prior art and the present invention is more clearly illustrated in FIGS. 5A and 5B, which show cross-sectional comparison of the tabs in the prior art and in one embodiment of the present invention respectively.

FIG. 5A illustrates a cross-sectional view of prior art tabs 42. Each tab includes a base portion 42A and a post portion 42B. Each base portion 42A extends outwardly from a pressure side 38 along a first distance D1. Each post portion 42B extends outwardly from the base portion 42A along a second distance D2, which is greater than the first distance D1. Therefore, the overall length L of the prior art tabs 42 is the same, that is, L=D1+D2.

FIG. 5B illustrates a cross-sectional view of tabs 72 and 76 according to one embodiment of the present invention. The first tab 72 includes a first base portion 72A and a first post portion 72B. The first base portion 72A extends outwardly from a pressure side 68 along a first distance D1. The first post portion 74B extends outwardly from the first base portion 72A along a second distance D2, which is greater than the first distance D1.

The second tab 76 includes only a base portion 76A. This base portion 76A extends outwardly from the pressure side 68 along a third distance D3, which is approximately equal to D1. The overall length L of the first tab 72 is D1+D2, which is significantly greater than D3.

Because the second tab 76 only includes the base portion 76A, the mechanical stress in the region surrounding the base portion 76A under the platform 64 is reduced. That is, because the second tab 76 of the present invention is shorter than the prior art tab 47, it does not extend into the cavity created between two adjacent turbine blades 30A and 30B to support the damper 44. As such, the mechanical stress, more specifically, the torsional stress induced by the damper 44 into the region under the platform 64 through the length of the prior art tab 47 no longer exists in the present invention.

Further, as discussed above, because the second tab 76 only includes the base portion 76A, the shorter second tab 76 provides an access area for coating application. This access provides an unimpeded line-of-sight for application of the second coating under the platform 64, which ensures complete coverage of the area of highest stress concentration including the first tab 72.

While the present invention is illustrated in a turbine blade, it should be understood that the invention would also be beneficial in a static structure such as a stator or a vane.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A turbine blade comprising:

a platform;

an airfoil extending outwardly from the platform in a first direction;

a root portion extending outwardly from the platform in a second direction different from the first direction, wherein the root portion has a pressure side and a suction side; and a plurality of tabs disposed on the root portion adjacent to the platform, wherein the plurality of tabs includes at least a first tab and a second tab disposed on the pressure side, wherein the first tab has a length significantly greater than a length of the second tab.

2. The turbine blade as recited in claim 1, wherein the plurality of tabs extend outwardly from the root portion in a direction that is substantially transverse to the first and second directions, to support a damper.

3. The turbine blade as recited in claim 1, wherein the plurality of tabs further includes a third tab and a fourth tab disposed on the suction side, wherein the third tab and the fourth have a length that is greater than the length of the second tab.

4. The turbine blade as recited in claim 1, wherein the first tab includes a base portion and a post portion extending outwardly from the base portion and the second tab includes a base portion, wherein the second tab base portion is defined by a length that is less than a combined length of the first tab base portion and the post portion.

5. The turbine blade as recited in claim 4, wherein the plurality of tabs includes a third tab and a fourth tab on the suction side extending outwardly from the root portion, wherein the third and fourth tabs each include a base portion and a post portion.

6. The turbine blade as recited in claim 1, wherein the first tab is at least twice as long as the second tab.

7. The turbine blade as recited in claim 1, further including:

a first coating applied to substantially cover the turbine blade;

a second coating applied over the first coating only on the pressure side of the platform of the turbine blade;

a third coating applied over the first coating only on the airfoil;

a fourth coating applied over the third coating only on the airfoil; and a fifth coating applied over the fourth coating to cover only a tip portion of the airfoil.

8. A gas turbine rotor comprising:

a plurality of turbine blades disposed about a circumference of the rotor, wherein adjacent turbine blades include:

a platform;

a first tab having a first length and a second tab having a second length, disposed below the platform on a pressure side, wherein the first length is significantly greater than the second length;

a third tab having a third length and a fourth tab having a fourth length, disposed below the platform on a suction side, wherein the third length and the fourth length are greater than the second length; and a damper supported between two adjacent turbine blades below the platform and above the first and second tab of one of the two adjacent turbine blade and above the third and fourth tab of the other of the two adjacent turbine blades.

9. A method of making a turbine blade comprising the steps of:

(a) providing a turbine blade with an access area below a platform by forming a short tab and a long tab;

(b) applying a first coating to substantially cover the turbine blade; and (c) applying a second coating only over the first coating below the platform through the access area provided in step (a).

10. The method of making a turbine blade as recited in claim 9, wherein the first coating is a low stress corrosion resistant coating.

11. The method of making a turbine blade as recited in claim 9, wherein the second coating is a high stress corrosion resistant coating.

12. The method of making a turbine blade as recited in claim 9, including applying the second coating via a line-of-sight application process.

13. The method of making a turbine blade as recited in claim 9, further including the step of heat treating the turbine blade prior to applying the second coating as recited in step (c).

14. The method of making a turbine blade as recited in claim 9, further including applying a third coating over the first coating only on the airfoil and applying a fourth coating only over the third coating, wherein the third coating is a metallic-bond coating and the fourth coating is a ceramic coating.

15. The method of making a turbine blade as recited in claim 14, further including the step of heat treating the turbine blade prior to applying the fourth coating.

16. The method of making a turbine blade as recited in claim 15, further including applying a fifth coating over the fourth coating only to a top portion of turbine blade, wherein the fifth coating is a cubic boron nitride coating.

* * * * *

UNITED STATES PATENT AND TRADEMARK OFFICE

CERTIFICATE OF CORRECTION

PATENT NO. : 7,467,924 B2
APPLICATION NO. : 11/205274
DATED : December 23, 2008
INVENTOR(S) : Charbonneau et al.

It is certified that error appears in the above-identified patent and that said Letters Patent is hereby corrected as shown below:

ON THE TITLE PAGE:

Item (75) Inventors:

Inventor Pietraszkiewicz's information should read as follows --Edward F. Pietraszkiewicz, Southington, CT (US)--

Signed and Sealed this

Twenty-fourth Day of March, 2009

JOHN DOLL
*Acting Director of the United States Patent and Trademark Office*